United States Patent [19]

Goldfarb et al.

[11] 4,349,984

[45] Sep. 21, 1982

[54] PRESCHOOL ASSEMBLY TOY

[75] Inventors: Adolph E. Goldfarb, 4614 Monarca Dr., Tarzana, Calif. 91356; Anita J. Goldfarb, Tarzana, Calif.

[73] Assignee: Adolph E. Goldfarb, Tarzana, Calif.

[21] Appl. No.: 233,493

[22] Filed: Feb. 11, 1981

[51] Int. Cl.[3] ..... A63H 33/06

[52] U.S. Cl. ..... 46/17; 46/241

[58] Field of Search ..... 46/241, 236, 17, 16, 46/116, 202, 201

[56] References Cited

U.S. PATENT DOCUMENTS

| | | | |
|---|---|---|---|
| 3,041,697 | 7/1962 | Budreck | 46/241 X |
| 3,713,246 | 1/1973 | Kilroy, Jr. | 46/17 |
| 3,805,444 | 4/1974 | Adickes | 46/17 X |

*Primary Examiner*—Paul J. Hirsch
*Assistant Examiner*—Mickey Yu
*Attorney, Agent, or Firm*—Romney, Golant, Martin, Disner & Ashen

[57] ABSTRACT

A simple preschool assembly toy for young children which comprises at least three relatively large parts that are assembled together by the child to provide a representation of a recognizable object such as a toy vehicle and driver. A first and a second part are positioned adjacent to one another and include mechanically inter-engaging elements which limits relative movement between these parts only in a first direction, while allowing them to be separated in a second direction generally transverse to the first direction. A third part is positionable adjacent to the other parts, and second inter-engaging elements are provided on the third part and one of the other parts to limit relative movement between the parts in the second direction. The second inter-engaging elements may be engaged and disengaged by motion only in the second direction; as for example by the provision of magnets. Thus, the manipulative skill required of the child is limited to linear movement rather than something more complicated such as rotating movement required to screw parts together. When the toy is assembled it may be played with as a unit, and of course may be readily disassembled and reassembled as the child may desire.

10 Claims, 5 Drawing Figures

PRESCHOOL ASSEMBLY TOY

BACKGROUND OF THE INVENTION

1. Field of the Invention

The present invention is in the field of toy devices, and more particularly relates to a toy for a child to play with by combining parts.

2. Description of the Prior Art

There are a variety of prior art toy devices where a plurality of pieces are connected together by the child to provide some object or design. In general such devices include erector and construction sets where typically the pieces are connected together by nuts and bolts, and other types of mechanical interconnections such as snap or friction fit. Such toys tend to be too sophisticated and difficult to use by younger preschool-age children.

Further, such prior art construction devices often involve small pieces which are not suitable for younger children because they are difficult to grab and manipulate and also because they may provide a risk of being swallowed by the child.

For younger children there are toys available and in the prior art where multipieces may be put together and taken apart by the child at a very simple level, however they tend to avoid the use of any interconnecting or interlocking means which would be too difficult for such younger children. As an example, there is a toy device which includes a base having an upright post and a plurality of rings of varying sizes that the child can stack on the post. Nothing holds the rings onto the post however, so that if the toy is tilted or inverted everything simply comes apart.

SUMMARY OF THE DISCLOSURE

The illustrated embodiments of the present invention contemplate simple preschool assembly toys each including at least three relatively large parts which may be assembled together by the young child in a very simple manner to provide a recognizable object. Interconnecting means which hold the parts together in the assembled condition are engagable and disengagable by simple linear movement solely in one direction and are thus manageable by younger children. Additional interconnecting means may be provided for limiting relative movement between the parts in the generally transverse direction, so that when assembled, the parts will tend to stay together and provide a unitary play object for use by the young child. In a presently preferred form, interconnecting magnets may be used, which tend to pop into interengagement when brought into close proximity with one another, thus providing a desirable action and sound associated for the child assembling the parts. As shown in the drawings, the illustrated presently preferred form of the device may comprise first and second parts which form a toy vehicle and a third part representing a driver or operator for the vehicle. The parts forming the vehicle may be stacked one upon the other and there may be mechanical interconnecting means on these two parts to limit their relative transverse or horizontal movement relative to one another, but not their relative vertical up and down movement. The upper part may comprise an opening or passage for a portion of the third part; the third part may also have an upper or second portion which is larger than the opening. The child may position the lower portion of the third part having a magnet at its end through the opening to interengage with a magnet on the lower of the two stacked parts. Thus, there is a mechanical interengagement between the two stacked parts and a magnetic or interengagement between the bottom stacked part and the third part, whereby all the parts are held together as a unitary toy vehicle and driver which the young child can play with in various positions and orientations without the parts disassembling. It is generally preferred that each of the parts be at least 1½ inches in at least one dimension. A preferred minimum size would be approximately 1½ inches by ½ inch by ¼ inch. Further in the preferred form of the device, the passage and the portion of the third part which is positioned in the passage are generally symmetrical about a central axis so that they may be readily assembled together by the young child without problems of properly orienting the parts with regard to such an axis.

DESCRIPTION OF THE DRAWINGS

The invention is illustrated, by way of example thereof, in the accompanying drawings, wherein.

DESCRIPTION OF THE PREFERRED EMBODIMENTS

Figure 1:
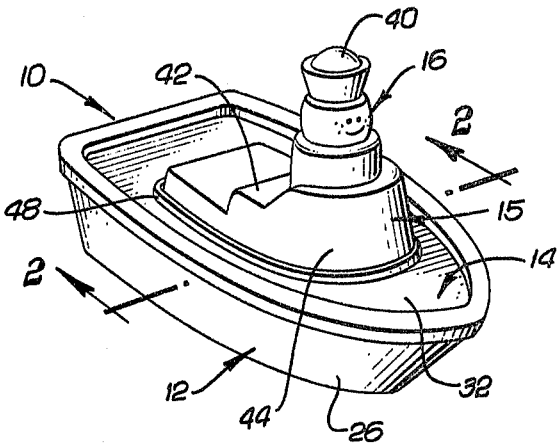
FIG. 1 is a perspective view of an assembly toy comprising a first embodiment of the present invention.
Figure 2:
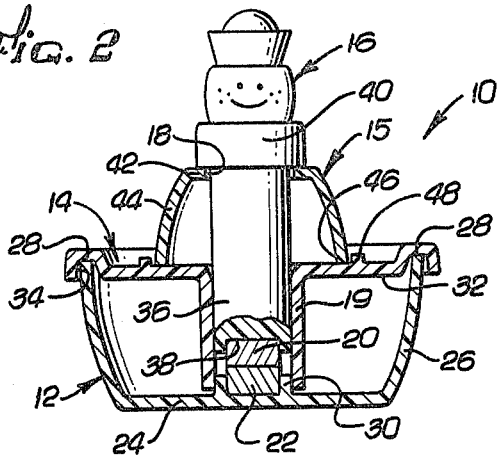
FIG. 2 is a sectional view taken generally along line 2—2 in FIG. 1.

In general, the illustrated preschool assembly toys 10 and 110 each comprise at least three relative large parts which may be assembled together by a young child to create a recognizible object each as a vehicle and its driver. Thus, as shown in FIG. 1 that toy 10 represents a boat and a sailor-operator of the boat. A first part 12 represents a hull of the toy boat, a second part 14 represents the deck of the toy boat, a third part 15 represents a cabin section and a fourth part 16 represents a sailor-operator. As best shown in FIG. 2, the second deck part 14 is stacked upon and interlocks with the first hull part 12 to limit transverse relative movement between them, but without limiting vertical relative movement between them. In other words, the deck part 14 may be moved up and down relative to the hull part 12 without restriction from the interlock between those two parts. The third cabin part 15 similarly is stacked upon and interlocks with the second deck part 14. The fourth sailor-operator part 16 extends through a hole 18 in the third cabin part 15 and a tubular section 19 in the second deck part 14. The sailor part 16 has a magnet 20 at its lower end which attaches to a magnet 22 secured within the first hull part 12 to hold the fourth sailor part to the first hull part and to thereby hold the second and third parts in place between the first and fourth parts.

More particularly, the parts may be made of any suitable material such as molded plastic, wood, metal or the like. The illustrated first hull part 12 simulates the hull shape of a toy row boat having a bottom wall 24 and an upstanding side wall 26 which terminates in a peripheral upper edge 28. A receptacle 30 is formed at an intermediate position on the upper side of the bottom wall 24 for holding the small magnet 22. The second deck part 14 has generally flat configuration approximately the shape of the upper edge of the hull part. The second deck part 14 is formed with a flat top wall 32 and a downwardly directed peripheral groove 34 which receives the upper peripheral edge 28 of the hull part to form an interengagement or interlock against transverse movement, as seen in FIG. 2. The groove 34 is formed by the peripheral edge of the part 14 being turned upwardly, extending outwardly, and then being turned downwardly. The deck part 14 has the depending circular tubular section 19 intermediate its edges that aligns with and receiving within its lower end the magnet receptacle 30 on the first part when the parts are assembled. The third cabin part 15 has a top wall 42 and a depending side wall 44 with a lower peripheral edge 46. There is an upstanding rib 48 on the upper surface of the top wall 32 of the deck part 14 that matches the outline of the peripheral edge 46. When the cabin part 15 is stacked on the deck part 14, the edge 46 nests within the rib 48 as shown in the drawings. This provides an interlock against transverse relative movement. The fourth sailor-operator part 16 has a generally cylindrical lower locking section or portion 36 which fits through the hole 18 in the cabin part and the tubular section 19 of the deck part. The locking section 36 has a receptable 38 at its lower end for fixedly receiving the small magnet 20. The sailor-operator part 16 also has an enlarged upper portion 40 which represents the torso, head and hat of the sailor-operator. It is only necessary that this upper portion 40 be enlarged relative to the hole 18 through the cabin part 15 and that the lower portion 36 be sufficiently long to allow the magnet 20 to magnetically attach to the magnet 22 in the bottom of the hull part 12. With the parts so assembled and interconnected as shown in FIG. 2, the mechanical interengagements limit transverse movement, while the magnetic interconnection limits vertical relative movement. It is noted that the hole 18 and the tubular section 19 are circular and the lower portion 36 of the third part has a mating circular configuration so that the exact orientation of that part 16, as the small child inserts it through the opening 18 and tubular section 19, is not critical. As the magnets 20, 22 come into close proximity they will tend to pull their respective parts together to provide a sound as the magnets strike each other as well as an interesting effect which the child holding the parts can feel.

The child-user may of course easily separate the parts by simple linear pulling of the sailor part 16 away from the first part 12.

Figure 3:
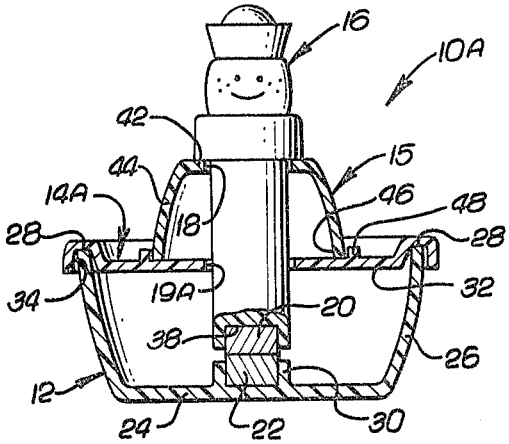
FIG. 3 is a view similar to FIG. 2 of a somewhat modified construction.

FIG. 3 illustrates a toy 10A that is a somewhat modified version of the boat toy 10 shown in FIGS. 1 and 2. The first hull part 12, the third cabin part 15, and the fourth sailor part 16 are the same. Instead of having tubular section, the second deck part 14A simply has a hole 19A.

It will be appreciated that for use by very young children, it is highly desirable that none of the parts be very small. In this connection, it has been found that the generally cylindrical third part should be at least about $1\frac{1}{2}$ inches long and at least about $\frac{1}{2}$ inch in diameter. Generally flat pieces such as the deck part are desirably at least about $2\frac{1}{4}$ to $2\frac{1}{2}$ inches long and at least about $\frac{3}{4}$ inches wide, and preferrably at least about $\frac{1}{4}$ inch thick, to permit them to be readily grasped and manipulated by the younger children and without danger of their being swallowed.

Figure 4:
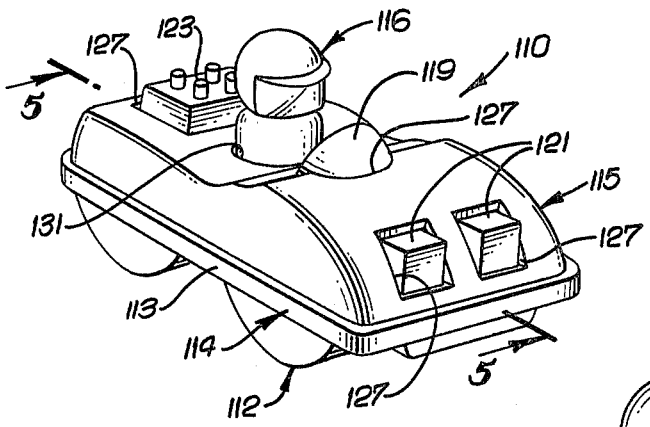
FIG. 4 is a perspective view of an assembly toy comprising another embodiment of the invention.
Figure 5:
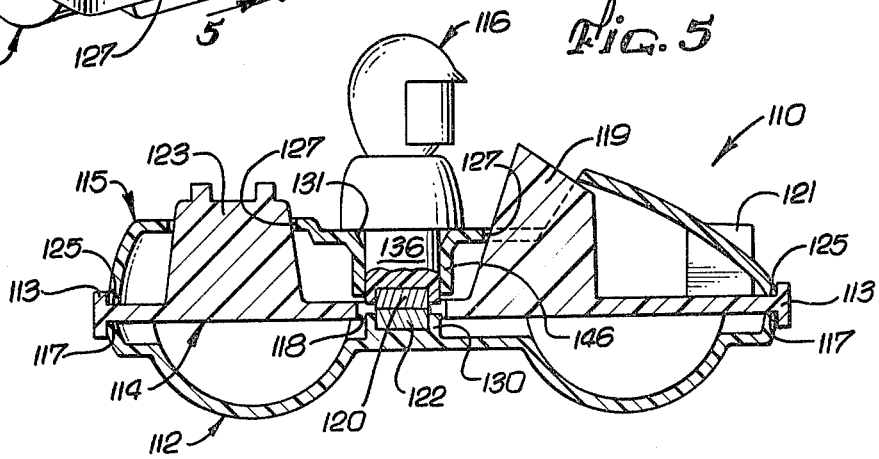
FIG. 5 is a sectional view taken generally along line 5—5 in FIG. 4.

A further embodiment of the toy 110 is illustrated in FIGS. 4 and 5. In that toy 110 there are three vertically stackable parts 112, 114, 115 which combine to form a toy vehicle and mechanically interlock against relative transverse movement but not against relative vertical movement. There is the first or bottom-most part 112 which simulates the underbody and wheels of the vehicle and has an upwardly directed receptacle 130 in which is secured a small magnet 122. There is the second or intermediate part 114 which has a generally flat configuration, having a peripheral flange 113 which extends both upwardly and downwardly. The upwardly directed peripheral lip 117 of the first or bottom-most part 112 rests within the lower portion of the peripheral flange 113. The intermediate part 114 includes several upstanding sections 119, 121, 123 simulating respectively the dashboard and windshield, the front lights, and the supercharged-motor of the toy vehicle. This intermediate part 114 also has a central opening 118 providing access to and aligned with the magnet 122 on the lower first part 112 when these parts are assembled upon one another. Still further there is the third or body part 115 simulating the appearance of the body of the toy vehicle. Part 115 has a downwardly directed peripheral edge 125 that mates with the upper portion of the peripheral flange 113 of the intermediate part 114. Part 115 also has a series of cut-outs 127 for the upstanding sections 119, 121, 123 of the part 114 to extend upwardly through. The part 115 also has a central opening 131 which continues downwardly as a tubular portion 146 and is aligned with the opening 118 in part 115 and the magnet 122 in the first part 112. In this embodiment, the toy driver-figure part 116 is the fourth part. Part 116 has a smaller diameter cylindrical lower portion 136 with a magnet 120 secured to its lower end, and an enlarged upper portion 140 which represents the drivers head and upper torso. When the parts 112, 114, 115 and 116 are assembled, the magnet 120 on the driver part 116 engages the magnet 122 on the bottom-most part 112 to prevent the stacked parts from readily disengaging until the magnets are pulled apart from one another.

Various modifications and changes may be made in the illustrated structures without departing from the spirit and scope of the present invention as set forth in the following claims. In particular, various other objects, animate and inanimate, could be represented with various shapes and configurations. Further, while it is desirable that the transverse configuration of the locking portion and the opening and/or tubular section in which it is received is symmetrical so that the relative rotational position of that part is not critical for the small child when he or she assembles the toy, multisided faces might be substituted for the cylindrical configuration while still enjoying the major benefit of a symmetrical configuration. Further, if desired, as for example to teach the child-user various shapes, a nonsymmetrical cross-sectional configuration might be utilized. While as noted above, magnets provide a simple economical and advantageous means for securing the parts together by simple linear motion to engage and disengage the magnets, other unidirectional engaging and disengaging means might be utilized. For example, interengaging surfaces of material known by the trademark "Velcro" or of repeating-adhesive material might be utilized. Further, a degree of friction fit might be utilized such as a tapered pin configuration in a complimentary hole. Still further, light mechanical unidirectional engagement and disengagement means such as a snap-fit arrangement might also be utilized. Obviously the exact number of pieces and their exact configurations are not critical to the present invention.

What is claimed is:

1. A simple multi-piece assembly toy for young children comprising at least three relatively large parts, the smallest of said parts being at least $1\frac{1}{2}$ inch in at least one direction and at least $\frac{1}{2}$ inch another direction;

(a) a first part;

(b) a second part designed to be positioned adjacent to the first part;

(c) a third part designed to be positioned adjacent to the second part;

said parts combining when positioned adjacent to one another to form the representation of a particular object visually identifiable by the child; first means on the parts which mechanically interengage to limit relative movement between said parts in only a first direction, while allowing them to be separated in a second direction generally transverse to said first direction; and second means on the parts which magnetically interengage to limit relative movement between the parts in said second direction; said second means being engaged and disengaged by motion solely in said second direction, said first and second parts representing a toy vehicle and said third part representing the operator for such vehicle.

2. The toy of claim 1 wherein said first mechanical interengaging means are on said first and second parts and said second magnetically interengaging means are on said first and third parts.

3. The toy of claim 2 wherein said mechanical interengaging first means comprises a peripheral lip on one of the parts and a mating peripheral groove on the other of said parts.

4. The toy of claim 1 wherein said second part is stacked atop said first part and said third part is positioned atop said first two parts.

5. The toy of claim 4 wherein said second part has a hole through it and said third part has a reduced size portion which extends through said hole to magnetically interconnect with means on said third part.

6. The toy of claim 5 wherein said hole and said reduced size portion are generally symmetrical and mating in horizontal section.

7. The toy of claim 6 wherein said hole is generally circular.

8. The toy of claim 1 wherein said first and second parts are stacked atop one another and said third part is generally cylindrical and is disposed with its axis generally upright.

9. The toy of claim 8 wherein the upper portion of said third part is enlarged and disposed above said second part and the lower portion of said third part is reduced in transverse cross section and extends through said second part into contact with magnetic means on said first part.

10. The toy of claim 5 further comprising means on said second part when defines an open tubular extension of said hole, said first part having means defining a matting portion for interlocking receipt in said open tubular extension.

* * * * *